US007304552B2

(12) United States Patent
Baird

(10) Patent No.: US 7,304,552 B2
(45) Date of Patent: Dec. 4, 2007

(54) WAVEGUIDE FOR USE IN DUAL POLARISATION PROBE SYSTEM HAVING A SIGNAL REFLECTOR AND ROTATOR PROVIDE DIFFERENTIAL PHASE SHIFT

(75) Inventor: Andrew Patrick Baird, Hampshire (GB)

(73) Assignee: Andrew Corporation, Joliet, IL (US)

( * ) Notice: Subject to any disclaimer, the term of this patent is extended or adjusted under 35 U.S.C. 154(b) by 0 days.

(21) Appl. No.: 11/592,795

(22) Filed: Nov. 3, 2006

(65) Prior Publication Data

US 2007/0096844 A1 May 3, 2007

Related U.S. Application Data

(63) Continuation of application No. 11/061,561, filed on Feb. 18, 2005, now abandoned, which is a continuation of application No. 10/684,173, filed on Oct. 10, 2003, now abandoned, which is a continuation of application No. 10/094,187, filed on Mar. 8, 2002, now abandoned, which is a continuation of application No. 09/254,771, filed on Jul. 12, 1999, now abandoned, which is a continuation of application No. PCT/GB97/02428, filed on Sep. 9, 1997.

(30) Foreign Application Priority Data

Sep. 9, 1996 (GB) ..... 9618744.8

(51) Int. Cl.
*H01P 1/161* (2006.01)
*H01P 1/165* (2006.01)

(52) U.S. Cl. ..... 333/137; 333/21 A

(58) Field of Classification Search ..... 333/21 A, 333/137

See application file for complete search history.

(56) References Cited

U.S. PATENT DOCUMENTS 4,365,253 A 12/1982 Morz et al.

FOREIGN PATENT DOCUMENTS

| | | | |
|---|---|---|---|
| EP | 0 041 077 | 12/1981 | |
| JP | 114155 | * 9/1979 | ..... 333/137 |
| JP | 3296301 | * 12/1991 | ..... 333/21 A |
| JP | 07 321502 | 12/1995 | |
| JP | 08 084001 | 3/1996 | |
| JP | 08 125403 | 5/1996 | |
| WO | WO 92022938 | * 12/1992 | ..... 333/21 A |
| WO | 96/28857 | 9/1996 | |

* cited by examiner

*Primary Examiner*—Benny T. Lee
(74) *Attorney, Agent, or Firm*—Darby & Darby

(57) ABSTRACT

A waveguide for use with a dual polarization waveguide probe system is described which provides an improved frequency response across a desired frequency range (10.7 to 12.75 GHz) and particularly at the band edges. This is achieved by providing a waveguide with a rotator that incorporates a reflector plate in combination with a differential phase shifter in the form of a waveguide of slightly asymmetrical cross section so that orthogonal signals which travel through this portion have a different cut-off wavelength. This results in a rotator which achieves 180° of phase shift between two orthogonal components across the frequency range of signals received by the waveguide. The reflector plate and the differential phase shifter have inverse frequency characteristics so that the combined phase shift characteristic of the rotator has a flatter frequency characteristic.

29 Claims, 7 Drawing Sheets

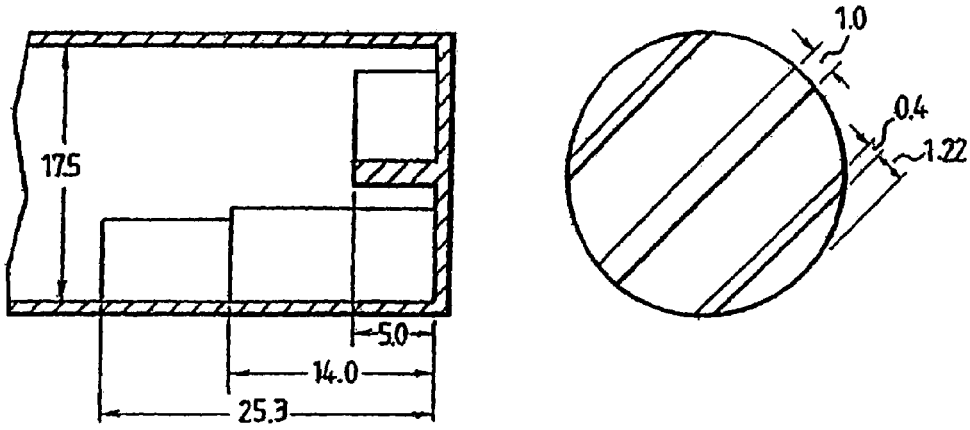
FIG.13a
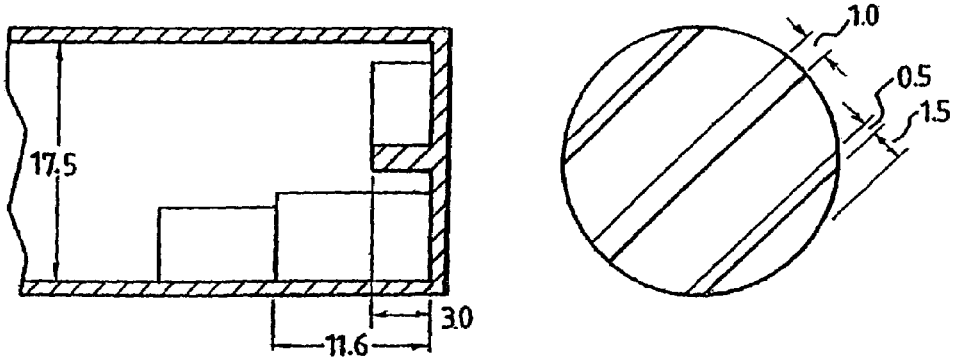
FIG.13b
FIG.14
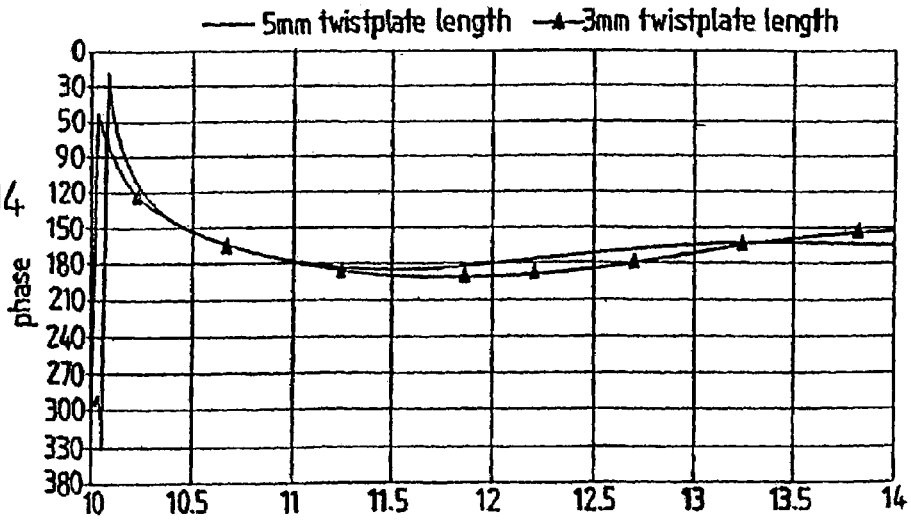

WAVEGUIDE FOR USE IN DUAL POLARISATION PROBE SYSTEM HAVING A SIGNAL REFLECTOR AND ROTATOR PROVIDE DIFFERENTIAL PHASE SHIFT

RELATED U.S. APPLICATION(S)

The present application is a continuation of application Ser. No. 11/061,561, filed on Feb. 18, 2005, now abandoned, which is a continuation of application Ser. No. 10/684,173, filed on Oct. 10, 2003, now abandoned, which is a continuation of application Ser. No. 10/094,187, filed on Mar. 8, 2002, now abandoned, which is a continuation of application Ser. No. 09/254,771, filed on Jul. 12, 1999, now abandoned, which is a continuation of Application Serial No. PCT/GB97/02428, filed on Sep. 9, 1997.

FIELD OF THE INVENTION

The present invention relates to a waveguide for use in a dual polarization waveguide probe system for use with a satellite dish receiving signals broadcast by a satellite which includes two signals orthogonally polarized in the same frequency band. In particular, the invention relates to an improved waveguide for use with a low-noise block receiver into which two probes are disposed for coupling from the waveguide, desired broadcast signals to external circuitry.

BACKGROUND OF THE INVENTION

In applicant's co-pending Published International Application WO92/22938, there is disclosed a dual polarization waveguide probe system in which a waveguide is incorporated into a low-noise block receiver in which two probes are located for receiving linearly polarized energy of both orthogonal senses. The probes are located in the same longitudinal plane on opposite sides of a single cylindrical bar reflector which reflects one sense of polarization and passes the orthogonal signal with minimal insertion loss and then reflects the rotated orthogonal signal. The probes are spaced $\lambda g/4$ from the reflector where $\lambda g$ is the wavelength of the signal propagating in the waveguide. A reflection rotator is also formed at one end of the waveguide using a thin plate which is oriented at 45° to the incident linear polarization with a short circuit spaced approximately a quarter of a wavelength ($\lambda g/4$) behind the leading edge of the plate. This plate splits the incident energy into two equal components in orthogonal planes, one component being reflected by the leading edge and the other component being reflected by the waveguide short circuit. The resultant 180° phase shift between the reflected components causes a 90° rotation in the plane of linear polarization upon recombination so that the waveguide output signals are located in the same longitudinal plane.

Furthermore, in applicant's co-pending International Patent Application PCT/GB96/00332, an improved dual polarization waveguide probe system was disclosed for use with a wider frequency range transmitted by new satellite systems. In this improved probe, a reflective twist plate was provided within the probe housing, the reflective twist plate having at least two signal reflecting edges so that at least two separate signal reflections are created. The multiple signal reflections enable the probe system to operate over a wider frequency range with minimal deterioration and signal output.

Although the improved version provides a better frequency response across the frequency range, it has been found that the amount of loss at the edges of the band still cause a significant performance degradation. With the increasing number of channels being used in satellite systems, it is desirable to be able to operate across the entire frequency band with substantially the same performance, to provide minimal degradation at the edges of the frequency band.

SUMMARY OF THE INVENTION

An object of the present invention is to provide an improved waveguide for use with a dual polarization probe system which obviates or mitigates the aforementioned disadvantage.

This is achieved by providing a waveguide for use with a dual polarization waveguide probe system which has a rotator which incorporates a reflecting plate in combination with a differential phase shifter in the form of a waveguide of slightly asymmetrical cross section so that orthogonal signals which travel through this portion have a different cut-off wavelength. This results in a rotator which achieves 180° of phase shift between two orthogonal components across the frequency range of signals received by the waveguide. The reflecting plate and the differential phase shifter have inverse frequency characteristics so that the combined phase shift characteristic of the rotator has a flatter frequency response across the desired frequency range.

In a preferred arrangement, the rotator consists of a single reflector plate with a single reflecting surface and the differential phase shifter has two pairs of flats cast into the waveguide bore, a first pair of flats being machined in at a first distance from the reflector plate and a second pair of flats machined nearer to the reflector plate at a second distance from the reflector plate, the second pair of flats being machined at a shallower depth than the first pair so that the flats of the second pair are nearer to the central axis of the waveguide. In an alternative arrangement, the rotator consists of a single reflector plate in an elliptical waveguide portion coupled to the cylindrical waveguide portion. The different cross-sections of the ellipse provide two different cut-off wavelengths for the orthogonal signals. The differential phase shifter may be implemented by any other suitable structure which has a slight cross-sectional asymmetry to create wavelengths with different cut-offs.

According to a first aspect of the present invention, there is provided a waveguide for use with a dual polarization waveguide probe system for receiving at least two signals which are orthogonally polarized, the waveguide comprising a waveguide tube into which at least two orthogonally polarized signals are received for transmission therealong, the waveguide having:

a first probe extending from a wall of the waveguide into the interior of the waveguide, the first probe being adapted to receive the orthogonal signal travelling in the same longitudinal plane thereof, a reflector extending from the wall of the waveguide, the reflector located downstream of the first probe lying in the longitudinal plane for reflecting signals in the first orthogonal plane back to the first probe and allowing the signal in the second orthogonal plane to pass along the waveguide, a second probe located downstream of the first reflector and extending from the wall of the waveguide into the interior of the waveguide and lying in the longitudinal plane, a signal reflector and rotator, including a short circuit at the end of the waveguide, located downstream of the second probe for receiving, rotating and reflecting the second orthogonally polarized signal back along the waveguide such that the rotated and reflected signal is received by the second probe, the signal reflector and rotator comprising a reflector in the form of a plate with a leading edge thereon to provide at least one reflecting edge portion for reflecting a first component of the second orthogonally polarized signal, the reflecting edge portion being spaced at a desired distance from the short circuit at the end of the waveguide, a differential phase shifter disposed in proximity to the rotating plate, the differential phase shifter having a slightly asymmetrical cross-section, whereby the first and second components of the second orthogonally polarized signal are phase shifted with respect to each other in the differential phase shift portion, then reflected respectively from the reflecting edge portion and from the short circuit before being further phase shifted when travelling back through the differential phase shift portion for recombination, the first and second components having different cut-off wavelengths, to provide a recombined signal for detection by the second probe.

Preferably, the rotator plate has a single reflecting edge portion across the width of the waveguide. Conveniently, the differential phase shifter is provided by an asymmetric structure in the form of flats cast into the interior of the waveguide structure. Preferably, two flats are provided on each side, the flats being parallel with and extending along the waveguide from the reflector plate. Alternatively, the slightly asymmetric portion is provided by an elliptical waveguide. Advantageously, the upstream flats are machined a greater distance into the waveguide surface than the downstream flats with the first (downstream) flats forming an impedance matching structure.

Conveniently, the waveguide differential phase shifter is provided by at least two pairs of stepped flats. Alternatively, the asymmetric portion may be provided by a smooth transition along the waveguide without a clear step instead of the flats. The smooth transition will be cast into the side of the waveguide parallel to the reflecting edge portion.

According to a second aspect of the present invention, there is provided a method of receiving at least first and second orthogonally polarized signals in a frequency range in a single waveguide and providing at least two outputs in a common longitudinal plane for providing a flatter characteristic across the frequency range, the method comprising the steps of, providing a first probe in the waveguide to receive a first orthogonally polarized signal, providing a reflector in the waveguide parallel to and downstream from the first probe for reflecting the first orthogonally polarized signal and for allowing passage of the second orthogonally polarized signal, providing a second probe in the waveguide parallel to and downstream of said reflector, the second probe being substantially orthogonal to the second orthogonally polarized signal which passes the second probe without being received by the second probe, providing a reflector plate at the end of the waveguide for reflecting a first component of the second orthogonal signal back towards the second probe, allowing a second component of the second orthogonal signal to travel towards the waveguide short circuit, modifying the length of the second component such that it has a different cut-off wavelength from the first component, reflecting the second component from the waveguide short circuit, recombining the first and second reflected components of the second orthogonal signal to create a recombined reflected signal, the recombined reflected signal being in the same plane as the second probe for detection thereby, the first and second reflected components having inverse frequency characteristics which combine to create a flatter frequency response across the frequency range.

The signal reflector and rotator is formed by the combination of a differential phase shifter and a reflector plate. The differential phase shifter is orientated at 45° to the incident signal such that a phase shift is introduced between the first and second component of the orthogonal (horizontal) signal. A further phase shift is introduced by the reflecting plate downstream. The combination of these gives 180° phase shift between the two components on recombination, providing a resultant signal in the plane of said second probe.

According to another aspect of the present invention there is provided a dual polarization waveguide probe structure, the structure having a waveguide, first and second probes disposed in the waveguide separated by a first reflector, the first and second probes and the reflector being disposed in the same plane, a second probe signal provider for providing a polarized component to the second probe, the second probe provider comprising a signal reflector and rotator for reflecting and rotating a polarized component for reception by the second probe, the reflector and rotator comprising a reflected edge portion for reflecting a first component of the polarized signal, and a differential phase shifter provided by a slightly asymmetrical waveguide portion and a waveguide short circuit for providing a reflected second component with a different cut-off wavelength from the first component, the first and second components having inverse frequency characteristics which when recombined provide a flatter frequency characteristic across the frequency range.

BRIEF DESCRIPTION OF THE DRAWINGS

These and other aspect of the invention will become apparent from the following description when taken in combination with the accompanying drawings, wherein like reference numerals refer to like and corresponding parts of the various drawings, in which:

FIGS. 6*a*, 6*b*, 6*c* and 6*d* are graphs comparing the responses of the dual polarization waveguide probe system with the waveguide according to the embodiments shown in FIGS. 1 to 4, wherein FIG. 6*a* is a graph of phase shift vs. frequency, FIG. 6*b* is a graph of insertion loss vs. frequency, FIG. 6*c* is a graph of return loss vs. frequency and FIG. 6*d* is a graph of phase shift vs. frequency similar to that shown in FIG. 6*a* but drawn to a larger scale.

FIGS. 13*a* and 13*b* show longitudinal sections of waveguides, similar to FIG. 3, for a 5 mm reflector plate and 3 mm reflecting plate respectively;

FIGS. 14, 15 and 16 are graphs of phase vs. frequency and insertion loss and return loss vs. frequency for the waveguides with 5-mm and 3-mm plates shown in FIGS. 13*a* and 13*b*.

DESCRIPTION OF THE PREFERRED EMBODIMENTS

Figure 1:
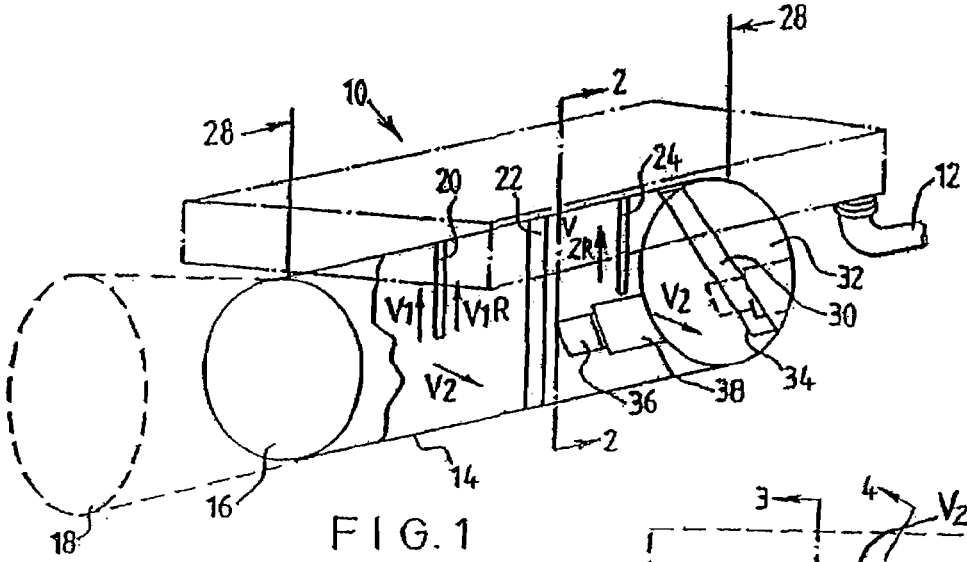
FIG. 1 is a partly broken away view of the low-noise block receiver with a waveguide probe including a waveguide with a reflector plate and a waveguide differential phase shifter in accordance with a preferred embodiment of the present invention.
Figure 2:
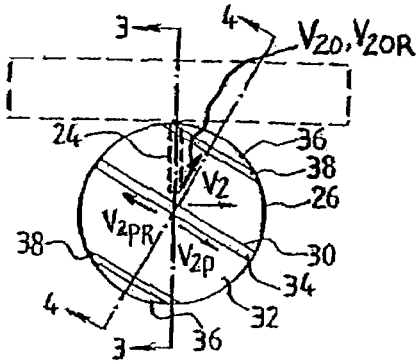
FIG. 2 is a cross-sectional view of the waveguide taken on the section 2-2 of FIG. 1.

Reference is first made to FIGS. 1 to 4 of the drawings in which a low-noise block receiver, generally indicated by reference numeral 10, is adapted to be mounted to a satellite receiving dish in a way which is well known in the art. As is also known, the low-noise block receiver 10 is arranged to receive high frequency radiation signals from the satellite dish and to process these signals to provide an output which is fed to a cable 12 which is, in turn, connected to a satellite receiver decoder unit (not shown in the interests of clarity). The block receiver 10 includes a waveguide 14 which is shown partly broken away in the interests of clarity to depict the interior components. The waveguide is cylindrical and is metal. The waveguide has front aperture 16 for facing a satellite dish for receiving electromagnetic radiation from a feed horn 18, shown in broken outline, which is mounted on the front of the waveguide. The waveguide and feed horn 18 are substantially the same as that disclosed in applicant's co-pending International Application PCT/GB96/00332 and WO 92/22938. Accordingly, disposed in the waveguide in the same longitudinal plane is a first probe 20, a reflective post 22 and a second probe 24 as shown in FIG. 1. In this embodiment, the reflective post 22 extends across the entire diameter of the interior of the waveguide. The outputs of the probes 20 and 24 pass through the waveguide wall 26 (FIGS. 2 and 3) along the same longitudinal plane generally indicated by reference numeral 28 in FIG. 1. The distance between the probe 20 and reflective post 22, and between probe 24 and reflective post 22 is nominally λg/4, where λg is the wavelength of the signals in the waveguide. At the downstream end of the waveguide which is furthest from the front aperture, there is disposed within the waveguide the reflector plate 30. As best seen in FIG. 2, the reflecting plate is oriented at an angle of 45° to the probes 20, 24 and reflecting-post 22. The furthest end of the plate terminates in a wall 32 which acts as a short circuit and which will be later described in detail.

It will be seen that the reflector plate is thin and has a single leading edge 34 which is orthogonal to the waveguide axis. Edge 34 is a fixed distance from the short circuit 32. With this arrangement, as best seen in FIG. 1, it will be appreciated that there is a single reflecting edge at the leading end of the reflector plate 30 spaced by a predetermined distance from wall 32.

Figure 3:
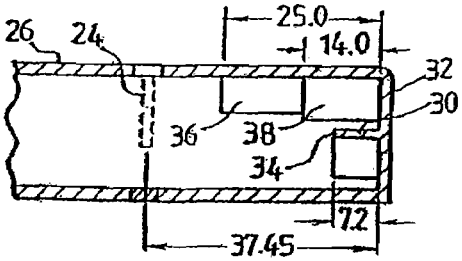
FIG. 3 is a sectional view taken on the lines 3-3 of FIG. 2.
Figure 4:
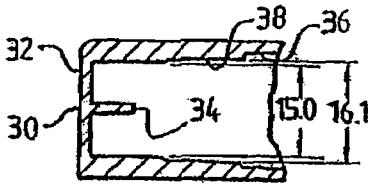
FIG. 4 is a sectional view taken on the lines 4-4 of FIG. 2.

Referring now to FIGS. 1 to 4, in the interior of the waveguide two sets of flats, 36, 38, are cast in the side of the waveguide. In the embodiment shown, the two sets of flats 36, 38, which are disposed parallel to the reflector plate 30 as best seen in FIG. 2. Flats 36 are cast further into the waveguide wall than flats 38 so that the waveguide has a profile as best shown in FIG. 4 where the waveguide appears to converge towards the base of the reflecting plate 30. The flats create a waveguide of slightly asymmetrical cross-section providing the differential phase shifter. The dimensions of flats 36 and 38 (in millimeters) in relation to the size of the reflector plate 30 and distance from the second probe 24 are shown in FIGS. 3 and 4. As shown in FIG. 3, reflector plate 30 and flats 38 extend 7.2 mm and 14 mm from short-circuit 32, respectively. Flats 36 extend an additional 11 mm from a front end of flats 38. Flats 36 are machined further into waveguide wall 26 than flats 38 for a total dimension of 25.00 mm from short-circuit 32. As shown in FIG. 4, flats 36 face each other at a distance of 16.1 mm where flats 38 are spaced only 15 mm from each other. Second probe 24 is positioned 37.45 mm from short circuit 32, as shown in FIG. 3.

In operation, signals from a satellite dish enter the waveguide 14 via the horn 18 and aperture 16 and, in accordance with known principles, are transmitted along the waveguide 14. The signals which are broadcast by the satellite include two sets of signals which are orthogonally polarized in the same frequency band and these are represented by vectors V1 and V2 (best seen in FIG. 1) which are signals polarized in the vertical and horizontal planes respectively. The flats in the waveguide have the effect of modifying the cut-off wavelength of the waveguide for both orthogonal components, $V_{2O}$ and $V_{2P}$ (FIG. 2) as indicated below. The change in cut-off wavelength leads to a change in the guide wavelength λg since the two are related to each other as indicated below.

$$\frac{1}{\lambda g^2} = \frac{1}{\lambda_O^2} - \frac{1}{\lambda_C^2}$$

λo=Free space wavelength

λg=Guide wavelength

λc=Cut-off wavelength

Figure 5:
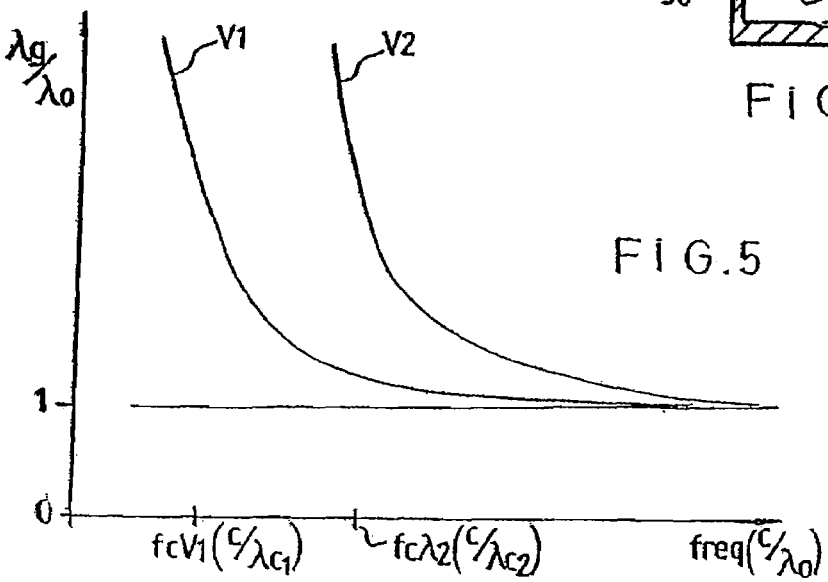
FIG. 5 is a graph of the ratio of guide wavelength to free-space wavelength vs. frequency showing the guide wavelength as a function of frequency for two different wavelengths.

Since $V_{2P}$ and $V_{2O}$ have different guide wavelengths, there will be a resultant phase shift between them per unit length of waveguide. This phase shift is a function of frequency, more phase shift being obtained at lower frequency. This can be seen by the graph shown in FIG. 5 showing the ratio of $\lambda_g/\lambda_o$ versus frequency ($c/\lambda_o$), where c is the speed of light. The cut-off frequency for signal V1 (fc V1) is $c/\lambda_{c1}$ and the cut-off frequency for signal V2 (fc V2) is $C/\lambda_{c2}$ where $\lambda_{c1}$, $\lambda_{c2}$ are the respective cut-off wavelengths for V1, and V2. The difference in wavelength is greater at lower frequencies since λg tends to infinity as cut-off is approached and tends to λo at higher frequencies. This variation of phase shift with frequency is opposite to the variation from the reflecting plate.

As the signals travel along the waveguide the vertically polarized signal V1 is received by the first probe 20 which, as it is spaced by λ/4 from the reflecting post 22, ensures the maximum field at the probe and hence optimum coupling to the probe because the reflected signal V1R is identical to V1. The probe 20 has no effect on the horizontally polarized signal V2 which continues to pass along the waveguide.

Because the reflecting post 22 is vertically oriented, the signal V2 is not reflected by the post and continues to pass along the waveguide and also passes the second probe 24 for the same reason. As the horizontally polarized signal V2 hits the front edge of the signal reflector and rotator (the start of the flats), the signal is split into $V_{2P}$ and $V_{2O}$ as seen in FIG. 2, where $V_{2P}$ is the phase component and $V_{2O}$ is the orthogonal component of the horizontally polarized signal V2. The influence of the flats phase shifts component $V_{2P}$ with respect to component $V_{2O}$, when the signal encounters the plate 30, $V_{2P}$ is reflected by edge 34. Component $V_{2O}$ continues until it is reflected by short circuit 32. The combination of the phase shift introduced by the flats 36 and 38 and the plate 30 gives 180° signal shift between the reflected signals $V_{2OR}$ and $V_{2PR}$ (FIG. 2), where $V_{2OR}$ is the reflected component of orthogonal component $V_{2O}$ and $V_{2PR}$ is the reflected component of phase component $V_{2P}$. Upon recombination, reflected signals $V_{2OR}$ and $V_{2PR}$ become output signal $V_{2R}$ (FIG. 1).

Figure 6A:
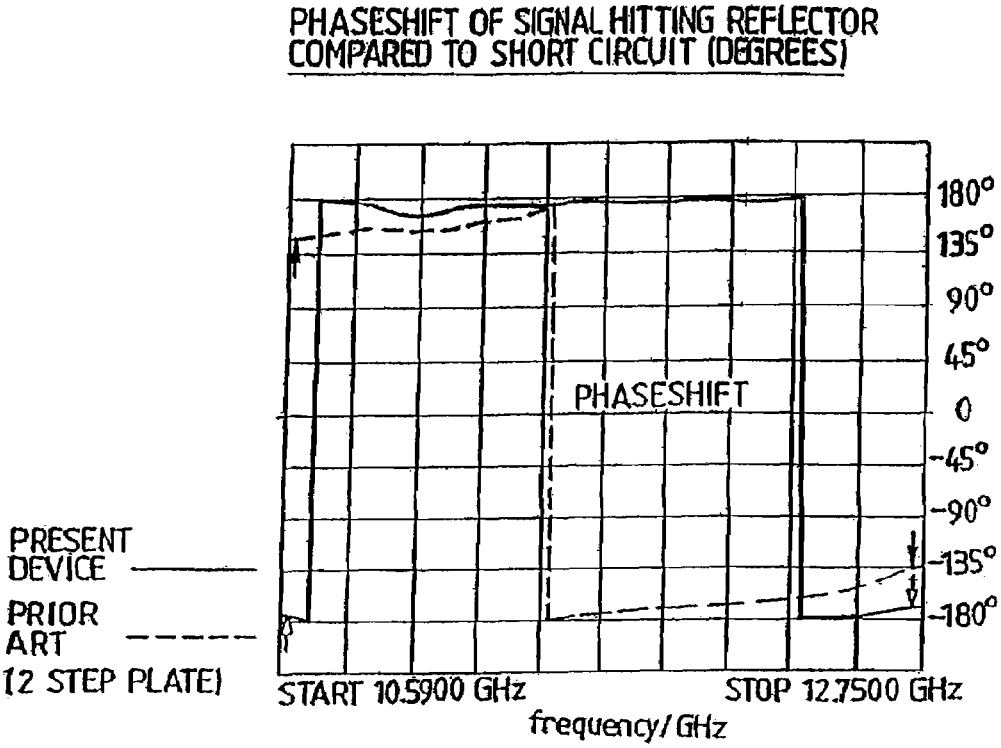

Reference is now made to FIGS. 6*a*, 6*b*, 6*c* and 6*d* of the drawings. In these drawings the present invention is represented by a solid line and the prior art by a broken line. Referring first to FIG. 6*a*, it will be seen that this is a graph of phase shift deviation from 180° from the rotator shown in FIGS. 1 to 4 with frequency over the Astra satellite range 10.7-12.75 GHz. It will be seen that the phase shift is substantially 180° across the entire frequency range for a reflected signal in orientation $V_{2PR}$ with respect to signal $V_{2OR}$. This offers substantial improvement over the arrangement provided by the prior art twist plate arrangement as disclosed in applicant's co-pending Application No. PCT/GB96/00332. This effectively means that the recombination of the signal is much better and in the plane of the second probe providing a better frequency response and insertion loss.

Figure 6B:
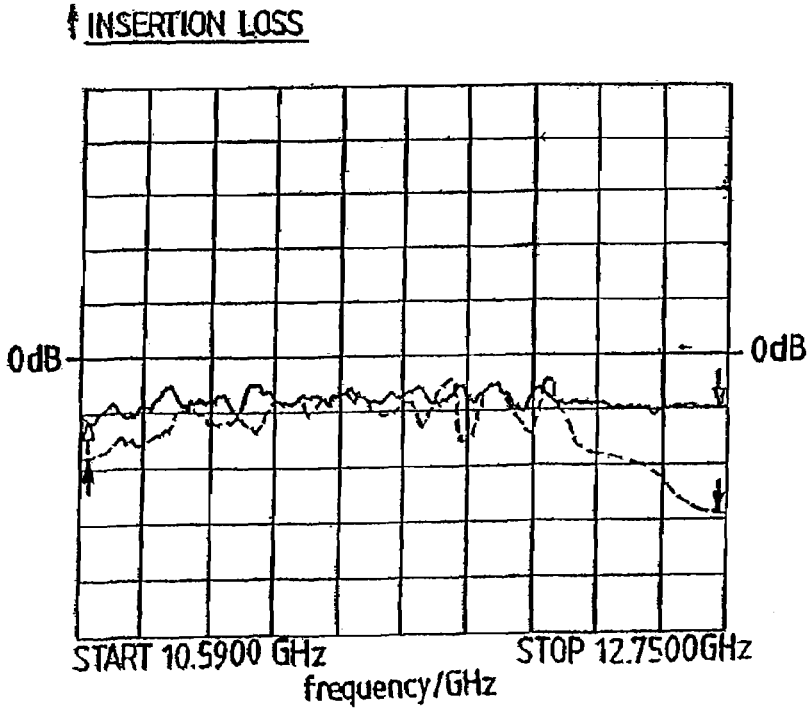

In this regard, reference is made to FIG. 6*b* of the drawing which shows the insertion loss with the rotator of the embodiments shown in FIGS. 1 to 4 compared with the insertion loss of the stepped twist plate arrangement as disclosed in the aforementioned application. It will be seen that the insertion loss or transmission loss in decibels is much less than the prior art arrangement, especially at the upper and lower frequency limits of the band. This means that there is a much better frequency response and signal response in these frequency regions.

Figure 6C:
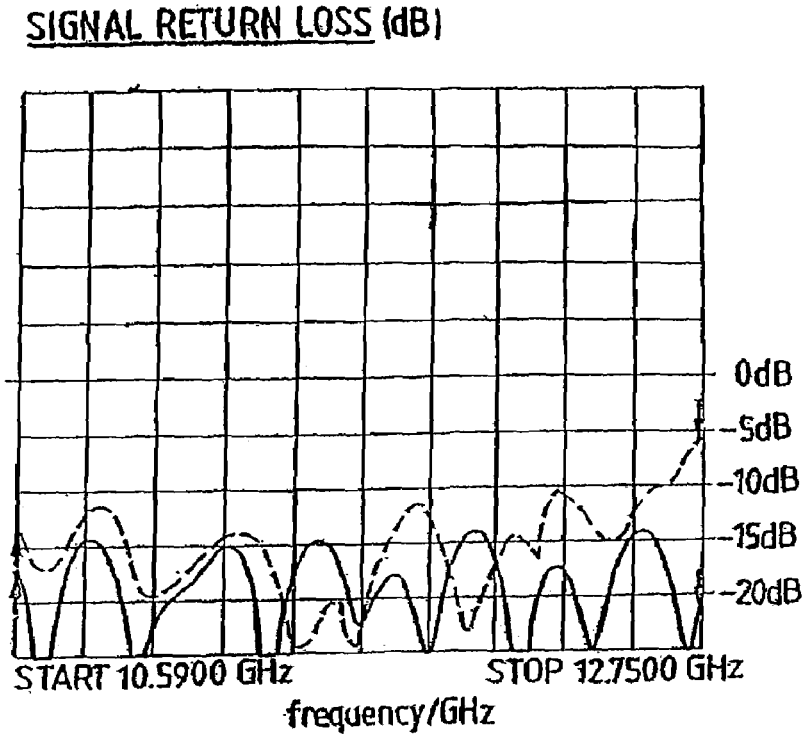

FIG. 6*c* is a graph of signal return loss (dB. versus frequency) which shows that there is less signal loss across the entire frequency range compared to the existing stepped twist plate and that there is a broader band of frequency for minimal return loss which shows a general improvement across the frequency band.

Figure 6D:
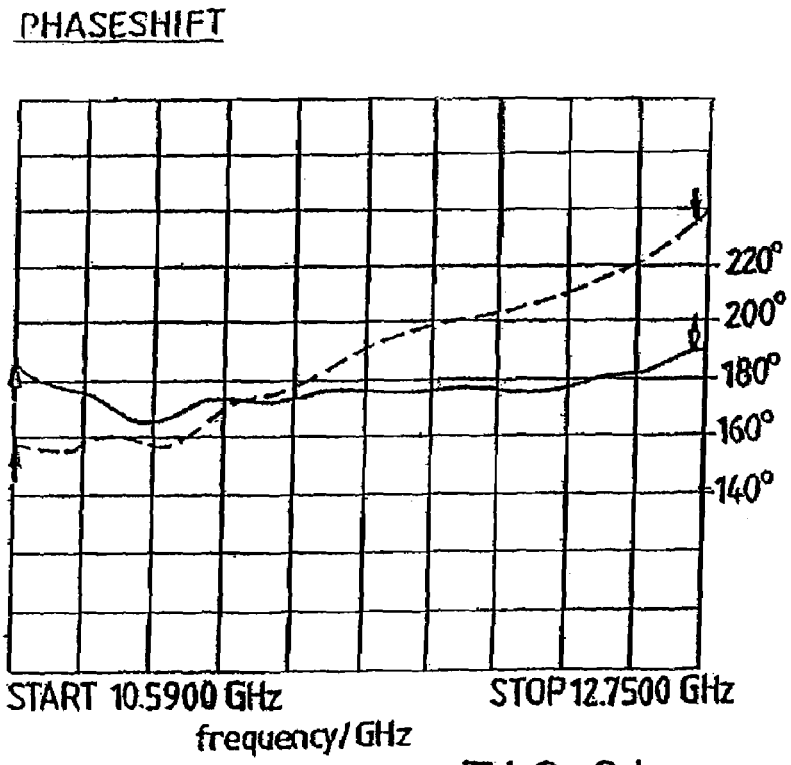

Referring to FIG. 6*d*, this shows an enlarged view of FIG. 6*a* where it will be seen that the phase shift characteristic is substantially flat around 180° and it will be seen that this offers a significant improvement over the prior art arrangement which is shown in broken outline.

Figure 9:
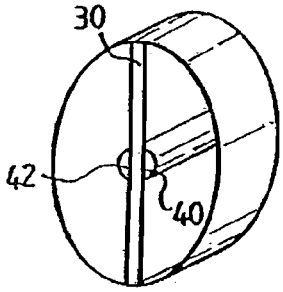
FIG. 9 is a view similar to FIG. 8*b* but with the reflector plate having protuberances for suppressing insertion loss 'glitches'.

In some cases, an insertion loss may occur over a relatively narrow bandwidth of a few MHz. This is believed to be due to manufacturing tolerances which result in a slight asymmetry of the twist plate/reflector plate. One solution to this problem has been to place small semi-cylindrical protuberances 40, 42 on the reflector plate 30 as shown in FIG. 9 which results in suppression of the insertion loss to an acceptable level. These protuberances 40, 42 are cast with the reflector plate 30.

Figure 10A:
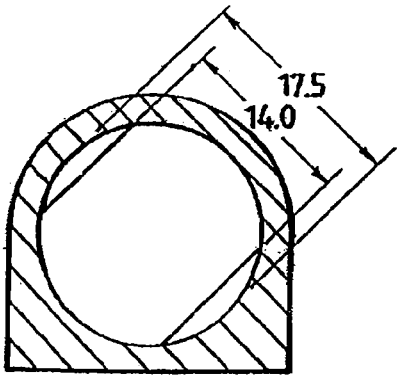
FIGS. 10*a*, 10*b* are side and longitudinal cross-sectional views through a waveguide with no reflector or twist plate and a differential phase shifter of flats only.
Figure 10B:
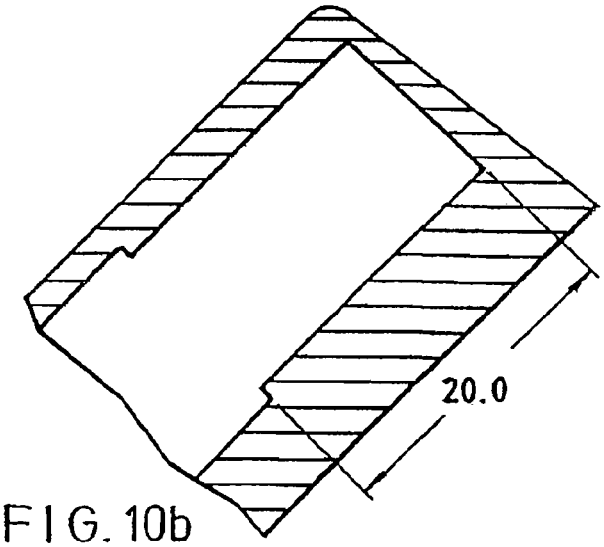
Figure 11:
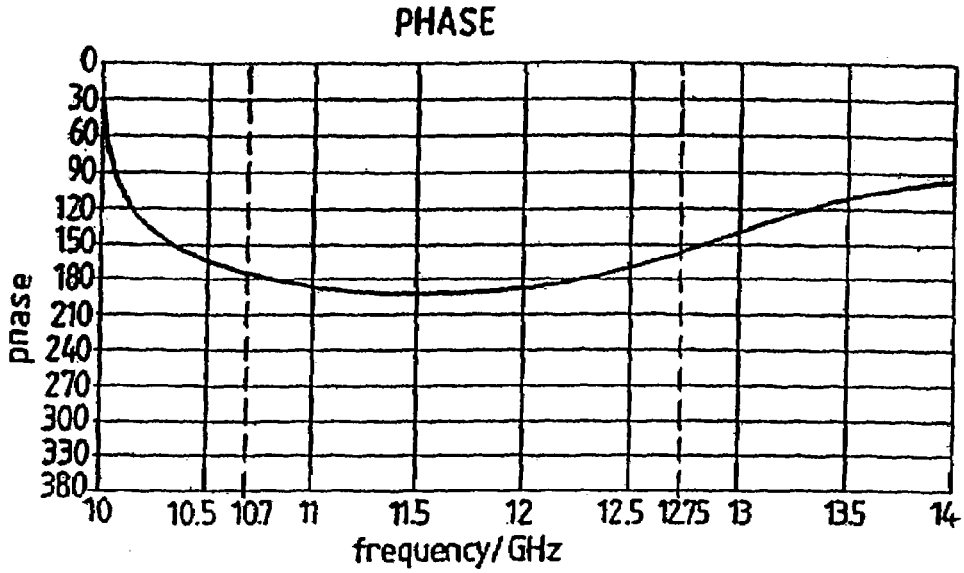
FIG. 11 is a graph of phase shift vs. frequency over the frequency range of interest for the waveguide shown in FIGS. 10*a* and 10*b;*
Figure 12:
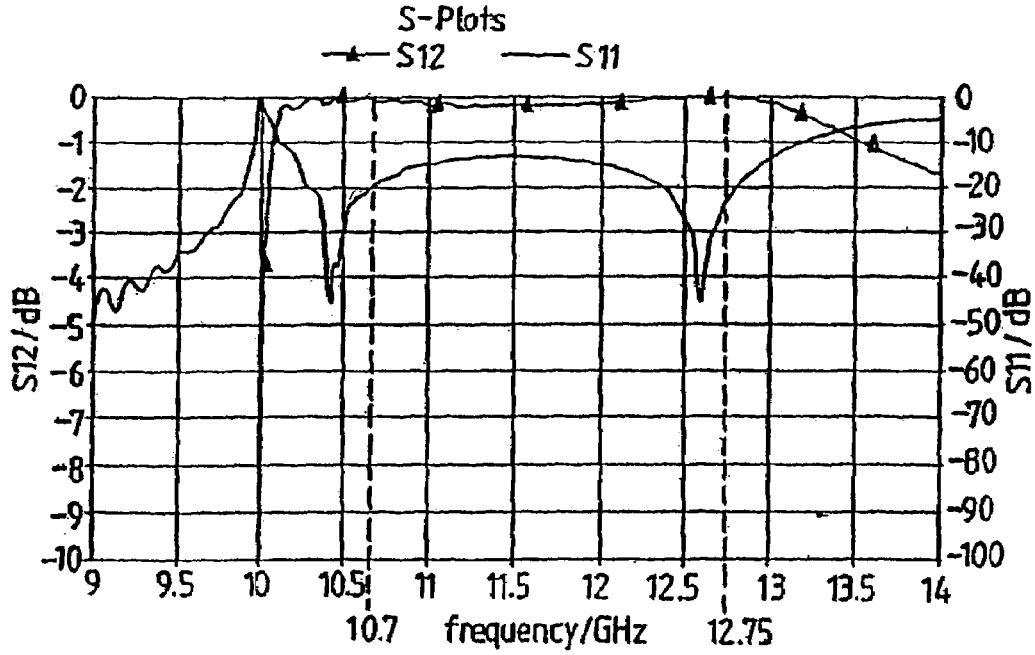
FIG. 12 is a graph of insertion loss and return loss over the frequency range of interest for the waveguide shown in FIGS. 10*a* and 10*b;*

Reference is also made to FIGS. 10*a*, 10*b* and 11 and 12 of the drawings which shows a waveguide which does not have a twist or reflector plate. In FIGS. 10*a* and 10*b* it will be seen that the waveguide has flats only. Otherwise, it is the same as the waveguide shown in FIG. 1. As shown, the flats are spaced 14.0-mm from each other (FIG. 10*a*) and span a length of 20.0-mm (FIG. 10*b*); the diameter of the waveguide is 17.5-mm (FIG. 10*a*). For a waveguide with the dimensions shown, FIG. 11 shows the phase shift over the frequency range of interest (10.7 to 12.75 GHz.) and FIG. 12 shows a graph of S-Plots such as insertion loss (S12) and return loss (S11) against frequency. From FIGS. 11 and 12 it will be seen that this waveguide performs quite well over the band of interest and as well as the stepped twist plate disclosed in applicant's co-pending Application PCT/GB93/00332.

Figure 15:
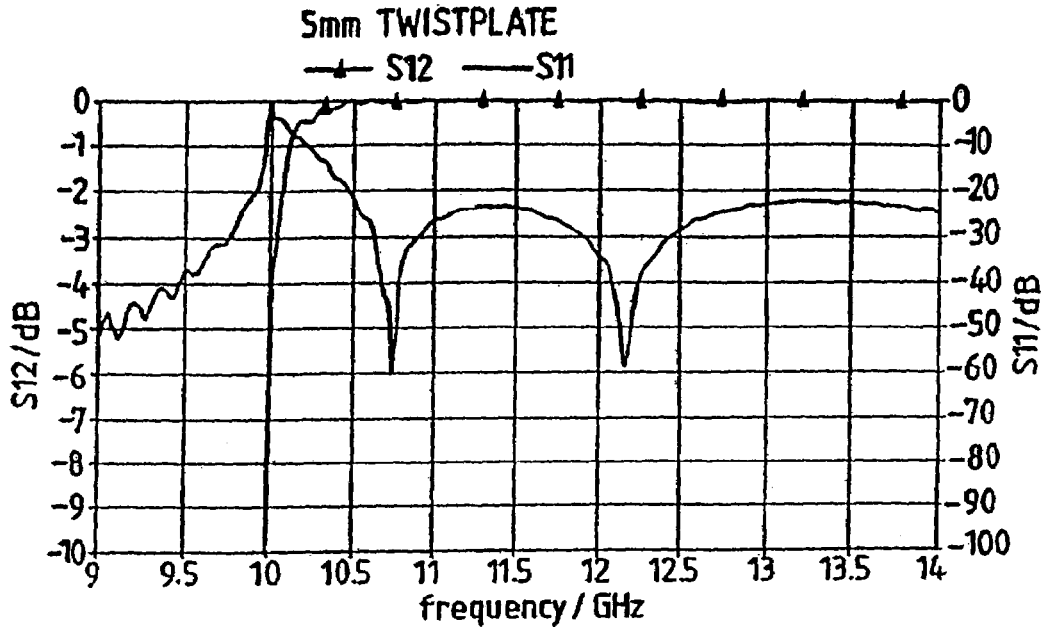
Figure 16:
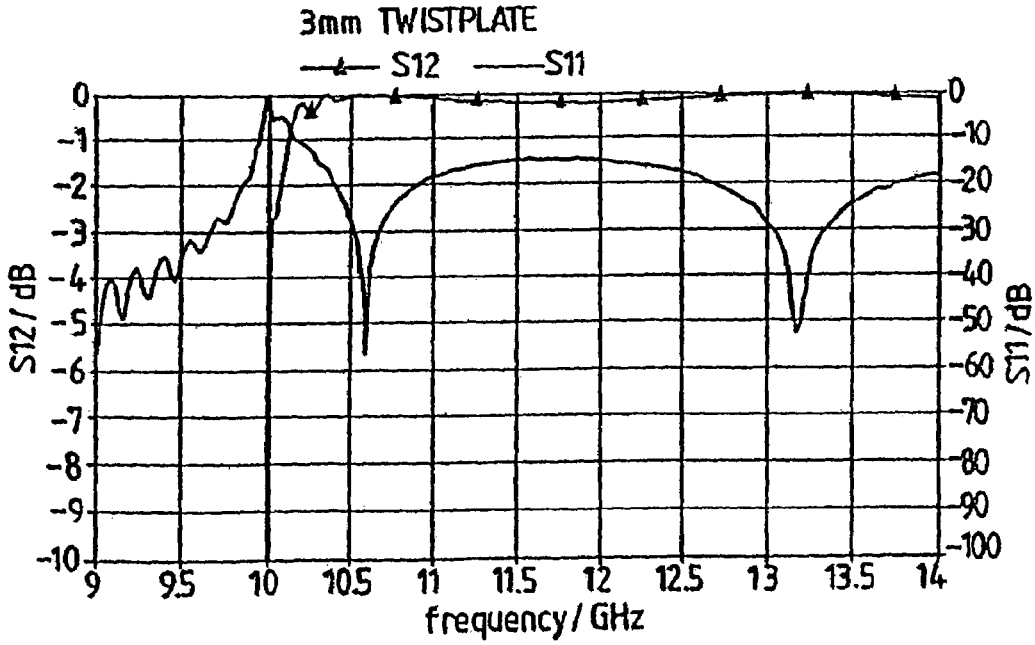

For example, FIGS. 14, 15 and 16 show graphs comparing the preference of the same diameter waveguide (17.5-mm in FIGS. 13*a*, 13*b*) with different lengths of reflector plate (5-mm in FIG. 13*a* and 3-mm in FIG. 13*b* respectively) and different lengths of flats as shown in FIGS. 13*a*, 13*b*. FIG. 13*a* shows a reflector plate that is 1.0-mm in width and extends 5.0-mm from the short-circuit. First flats extend 14.0-mm from the short-circuit and are a maximum of 1.62-mm from the waveguide wall, while second flats extend from the end of the first flats to a distance of 25.3-mm from the short-circuit and are a maximum of 1.22-mm from the waveguide wall. Thus first flats are 0.4-mm further into the waveguide than second flats. In contrast, FIG. 13*b* shows a reflector plate that is 1.0-mm in width and extends 3.0-mm from the short-circuit. First flats extend 11.6-mm from the short-circuit and are a maximum of 2.0-mm from the waveguide wall. Second flats extend from the end of the first flats and are a maximum of 1.5-mm from the waveguide wall, 0.5-mm less than first flats. The version shown in FIG. 13*a* moves any small insertion loss 'glitches' outside the top of the frequency band with a small performance penalty. FIG. 14 shows the phase shift of both the embodiment of FIG. 13*a* (5.0 mm twistplate) and the embodiment of FIG. 13*b* (3.0 mm twistplate). FIGS. 15 and 16 show the return loss (S11) and insertion loss (S12) vs. frequency of the 5-mm Twistplate and 3-mm Twistplate in embodiments of FIGS. 13*a* and 13*b* respectively.

Figure 7A:
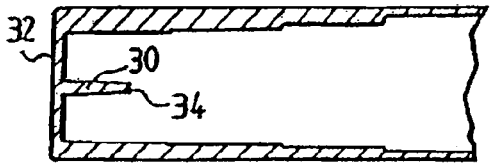
FIGS. 7*a* and 7*b* show rotators with alternative arrangements of flats in the waveguide wall.
Figure 7B:
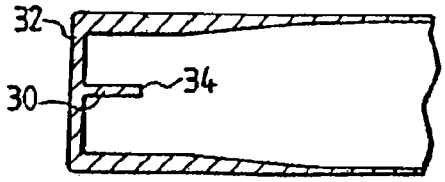
Figure 8A:
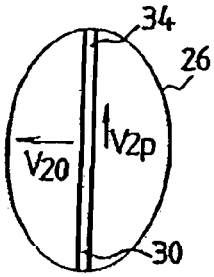
FIGS. 8*a* and 8*b* show cross-sectional views through alternative slightly different differential phase shifters of the waveguide.
Figure 8B:
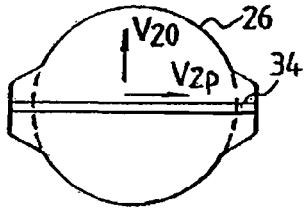

Various modifications may be made to the rotator structure for use with the waveguide as hereinbefore described without departing from the scope of the invention. For example, a single parallel flat may also be used or two or more pairs of flats may be machined into the side of the waveguide as shown in FIG. 7*a*. In addition, flats need not be stepped but may be provided by a smooth transition curve as shown in FIG. 7*b* of the drawings. Also, the asymmetry of the waveguide cross-section can be provided by a number of different shapes, for example elliptical, as shown in FIG. 8*a* or with a wider cross-section as shown in FIG. 8*b*. It will be appreciated that the exact dimensions of the flats, or transition curve and cross-sections, and the size of the reflector plate, may be varied in accordance with specific signal and frequency range requirements. It will also be understood that the protuberances may be of any suitable shape and can be single or double. They may be installed onto the reflector plate after casting. A 'suitable shape' is one which results in suppression of any insertion loss over the narrow bandwidth due to plate asymmetry. However, it will be understood that the basic invention is a combination of reflecting plate and the differential phase shifter section in the sides of the waveguide, in which a differential phase shifter is provided by a cross-section of slight asymmetry so that reflected orthogonal components of the second orthogonally polarized signals have different wavelength cut-offs which when recombined create a recombined reflected signal which has a substantially 180° phase shift across the desired frequency range.

It will be appreciated that the principal advantage of the present invention is that the reflecting and rotating arrangement allows the LNB to be used across the existing satellite bandwidth but which provides a much better frequency characteristic at the upper and lower frequency limits. This allows an increased number of channels to be used across the entire frequency band with substantially the same performance, that is providing minimal degradation at the edges of the frequency band. A further advantage of this arrangement is that it can be used with existing manufacturing techniques and does not require any special fabrication. It will also be understood that this particular apparatus and methodology may be applied to providing bandwidth improvements at frequency ranges outside the aforementioned Astra frequency range.

The invention claimed is:

1. A waveguide for use with a dual polarization waveguide system for receiving at least two signals which are orthogonally polarized, said waveguide comprising a waveguide tube into which at least two orthogonally polarized signals are received for transmission therealong, said waveguide having;

a first probe extending from a wall of the waveguide tube into an interior of the waveguide tube, said first probe lying in a first longitudinal plane and being adapted to receive a first one of said orthogonally polarized signals traveling in longitudinal plane, a reflector extending from the wall of the waveguide tube, said reflector located downstream of the first probe and lying in the first longitudinal plane for reflecting said first one of said orthogonally polarized signals back to said first probe and allowing a second one of said orthogonally polarized signals to pass along the waveguide tube, a second probe located downstream of said reflector and extending from the wall of said waveguide tube into the interior of the waveguide tube and lying in said first longitudinal plane, a signal reflector and rotator, including a short circuit at an end of the waveguide tube, said signal reflector and rotator located downstream of said second probe for receiving, rotating and reflecting said second one of said orthogonally polarized signals back along said waveguide tube such that the rotated and reflected signal is received by said second probe, said signal reflector and rotator also including, a differential phase shifter disposed between the second probe and the short circuit, said differential phase shifter having a slightly asymmetrical cross section provided by an elliptical section in said waveguide tube, whereby a first component of said second one of said orthogonally polarized signals is phase shifted with respect to a second component of said second one of said orthogonally polarized signals in the differential phase shifter, then said first and second components are reflected respectively from said short circuit and a reflector plate before said first component is further phase shifted when traveling back through the differential phase shift portion for recombination with said second component, said reflected first and second components having different cut off wavelengths, to provide a recombined signal for detection by said second probe.

2. A waveguide as claimed in claim 1, wherein the elliptical section is provided by a smooth transition along the waveguide tube.

3. A waveguide for use with a dual polarization waveguide probe system for receiving at least two signals which are orthogonally polarized, said waveguide comprising a waveguide tube into which said at least two orthogonally polarized signals are received for transmission therealong, said waveguide having:

a first probe extending from a wall of the waveguide tube into the interior of the waveguide tube, said first probe lying in a first longitudinal plane and being adapted to receive a first one of said at least two orthogonally polarized signals traveling in said first longitudinal plane, a reflector extending from the wall of the waveguide tube, said reflector located downstream of the first probe and lying in the first longitudinal plane for reflecting said first one of said at least two orthogonally polarized signals in said first longitudinal plane back to said first probe and allowing a second one of said at least two orthogonally polarized signals traveling in a second longitudinal plane to pass along the waveguide tube, a second probe located downstream of said reflector, extending from the wall of said waveguide tube into the interior of the waveguide tube and lying in said first longitudinal plane, a signal reflector and rotator, including a short circuit at an end of the waveguide tube, located downstream of said second probe for receiving, rotating and reflecting said second one of said at least two orthogonally polarized signals back along said waveguide tube such that the rotated and reflected signal is received by said second probe, said signal reflector and rotator comprising a reflector plate with a leading edge thereon to provide at least one reflecting edge portion for reflecting a first component of said second one of said at least two orthogonally polarized signals, the at least one reflecting edge portion being spaced at a desired distance from the short circuit at the end of the waveguide tube, a differential phase shifter disposed in proximity to the reflector plate, said differential phase shifter having a slightly asymmetrical cross-section comprised of a plurality of flats provided on the interior of the waveguide tube, whereby a second component of said second one of said at least two orthogonally polarized signals is phase shifted with respect to said first component, then said first and second components of said second one of said at least two orthogonally polarized signals are reflected respectively from said at least one reflecting edge portion and from said short circuit before said second component is further phase shifted when traveling back through the differential phase shifter for recombination with said first component, said first and second components having different cut off wavelengths, to provide a recombined signal for detection by said second probe.

4. A waveguide as claimed in claim 3 wherein the plurality of flats include two flats provided on each side of the waveguide tube, the flats being parallel with and extending along the waveguide tube from the reflector plate.

5. A waveguide as claimed in claim 4 wherein a first one of the two flats provided on each side of the waveguide tube is provided in an upstream location on said waveguide tube which is closer to an open end of said waveguide tube with respect to a second one of each of the two flats provided on each side of the waveguide tube which are provided at a downstream location further away from said open end, said open end being substantially opposite a closed end of said waveguide tube, the upstream flats being provided a greater distance into the waveguide surface than the downstream flats with the downstream flats thereby providing an impedance matching structure.

6. A waveguide as claimed in claim 3 wherein the at least one reflecting edge portion is a single reflecting edge portion across the width of the waveguide tube.

7. A waveguide as claimed in claim 3 wherein the plurality of flats include at least two pairs of stepped flats.

8. A waveguide as claimed in claim 3 wherein the differential phase shifter further comprises a smooth transition along the waveguide tube.

9. A waveguide as claimed in claim 8 wherein the smooth transition is provided on a side of the waveguide tube parallel to the at least one reflecting edge portion.

10. A waveguide as claimed in claim 3 wherein at least one protuberance is provided on the reflector plate for suppressing any insertion loss glitches which occur within a desired frequency band.

11. A method of receiving at least first and second orthogonally polarized signals in a frequency range in a single waveguide and providing at least two outputs in a common longitudinal plane for providing a flatter characteristic across the frequency range, said method comprising the steps of, providing a first probe in said waveguide, said first probe associated with a first output of said at least two outputs, to receive a first orthogonally polarized signal, providing a reflector in said waveguide parallel to and downstream from said first probe for reflecting said first orthogonally polarized signal and for allowing passage of a second orthogonally polarized signal, providing a second probe in said waveguide, said second probe associated with a second output of said at least two outputs, parallel to and downstream of said reflector, said second probe being substantially orthogonal to said second orthogonally polarized signal which passes the second probe without being received by the second probe, providing a reflector plate at an end of the waveguide for reflecting a first component of said second orthogonally polarized signal back towards said second probe, allowing a second component of said second orthogonally polarized signal to travel towards a waveguide short circuit, passing said second component through a differential phase shifter having a slightly asymmetrical cross-section comprised of flats provided on an interior of the waveguide, reflecting said second component from said waveguide short circuit, recombining said first and second reflected components of said second orthogonal signal to create a recombined reflected signal, said recombined reflected signal being in the same plane as said second probe for detection thereby, said first and second reflected components having inverse frequency characteristics which combine to create a flatter frequency response across said frequency range.

12. A method as claimed in claim 11 including a step of forming a reflector and rotator by combining the differential phase shifter and reflector plate.

13. A method as claimed in claim 11 wherein a phase shift between the first and second components of the second orthogonally polarized signal is introduced by orienting the differential phase shifter at 45° to the second orthogonally polarized signal.

14. A method as claimed in claim 11 including the a step of providing protuberances, on the reflector plate to minimize insertion loss glitches within the frequency band of interest.

15. A dual polarization waveguide probe structure, said structure having a waveguide, first and second probes disposed in the waveguide separated by a first reflector, said first and second probes and said reflector being disposed in the same plane, a second probe signal provider for providing a polarized signal to said second probe, said second probe signal provider comprising a signal reflector and rotator for reflecting and rotating a polarized component for reception by said second probe, said signal reflector and rotator comprising a reflected edge portion for reflecting a first component of said polarized signal, and a differential phase portion provided by a slightly asymmetrical waveguide portion and a waveguide short circuit for providing a reflected second component of said polarized signal with a different cut off wavelength from said first component, the reflected first and second components having inverse frequency characteristics which when recombined provide a flatter frequency characteristic across a desired frequency range.

16. A waveguide for use with a dual polarization waveguide system for receiving at least two signals which are orthogonally polarized, said waveguide comprising a waveguide tube into which the at least two orthogonally polarized signals are received for transmission therealong, said waveguide having;

a first probe extending from a wall of the waveguide tube into an interior of the waveguide tube, said first probe lying in a first longitudinal plane and being adapted to receive a first one of said orthogonally polarized signals traveling in said first longitudinal plane, a reflector extending from the wall of the waveguide tube, said reflector located downstream of the first probe and lying in the first longitudinal plane for reflecting said first one of said orthogonally polarized signals in said first longitudinal plane back to said first probe and allowing a second one of said orthogonally polarized signals to pass along the waveguide tube, a second probe located downstream of said reflector and extending from the wall of said waveguide tube into the interior of the waveguide tube and lying in said first longitudinal plane, a signal reflector and rotator, including a short circuit at an end of the waveguide tube, said signal reflector and rotator located downstream of said second probe for receiving, rotating and reflecting said second one of said orthogonally polarized signals back along said waveguide tube such that the rotated and reflected signal is received by said second probe, said signal reflector and rotator also including, a differential phase shifter disposed between the second probe and the short circuit, said differential phase shifter having a slightly asymmetrical cross-section comprised of flats provided on the interior of the waveguide tube, whereby a first component of said second one of said orthogonally polarized signals is phase shifted with respect to a second component of said second one of said orthogonally polarized signals in the differential phase shift portion, then said first and second components are reflected respectively from said short circuit and a reflector plate before said first component is further phase shifted when traveling back through the differential phase shifter for recombination with said second component, said reflected first and second components having different cut off wavelengths, to provide a recombined signal for detection by said second probe.

17. A waveguide as claimed in claim 16 wherein the flats include at least two pairs of stepped flats.

18. A waveguide as claimed in claim 16 wherein the flats include two flats provided on each side of the waveguide tube, the flats being parallel with the reflector plate and extending along the waveguide tube.

19. A waveguide as claimed in claim 18 wherein a first one of the two flats provided on each side of the waveguide tube is provided in an upstream location on said waveguide tube which is closer to an open end of said waveguide tube with respect to a second one of each of the two flats provided on each side of the waveguide tube which are provided at a downstream location further away from said open end, said open end being substantially opposite a closed end of said waveguide tube, the upstream flats being provided a greater distance into the waveguide surface than the downstream flats with the downstream flats thereby providing an impedance matching structure.

20. A waveguide as claimed in claim 16, wherein the differential phase shifter is provided by a smooth transition along the waveguide tube.

21. A waveguide as claimed in claim 20 wherein the smooth transition is provided on a side of the waveguide tube parallel to at least one reflecting edge portion of the reflector plate.

22. A method of receiving at least first and second orthogonally polarized signals in a frequency range in a single waveguide and providing at least two outputs in a common longitudinal plane for providing a flatter characteristic across the frequency range, said method comprising the steps of, providing a first probe in said waveguide to receive the first orthogonally polarized signal, said first probe associated with at least one of the at least two outputs, providing a reflector in said waveguide parallel to and downstream from said first probe for reflecting said first orthogonally polarized signal and for allowing passage of said second orthogonally polarized signal, providing a second probe in said waveguide parallel to and downstream of said reflector, said second probe associated with at least one other of the at least two outputs, said second probe being substantially orthogonal to said second orthogonally polarized signal which passes the second probe without being received by the second probe, providing a reflector plate at an end of the waveguide for reflecting a first component of said second orthogonally polarized signal back towards said second probe, allowing a second component of said second orthogonally polarized signal to travel towards a waveguide short circuit, passing said second component through a differential phase shifter having a slightly asymmetrical cross-section provided by an elliptical section in said waveguide, reflecting said second component from said waveguide short circuit, recombining said first and second reflected components of said second orthogonally polarized signal to create a recombined reflected signal, said recombined reflected signal being in the same plane as said second probe for detection thereby, said first and second reflected components having inverse frequency characteristics which combine to create a flatter frequency response across said frequency range.

23. A method as claimed in claim 22 wherein a phase shift between the first and second components of the second orthogonally polarized signal is introduced by orienting the differential phase shifter at 45° to the second orthogonally polarized signal.

24. A method as claimed in claim 22 including a step of providing protuberances, on the reflector plate to minimize insertion loss glitches within a frequency band of interest.

25. A method as claimed in claim 22 including a step of forming a signal reflector and rotator by combining the differential phase shifter and the reflector plate.

26. A waveguide for use with a dual polarization waveguide probe system for receiving at least two signals which are orthogonally polarized, said waveguide comprising a waveguide tube into which said at least two orthogonally polarized signals are received for transmission therealong, said waveguide having;

a first probe extending from a wall of the waveguide tube into the interior of the waveguide tube, said first probe lying in a first longitudinal plane and being adapted to receive a first one of said at least two orthogonally polarized signals traveling in said first longitudinal plane, a reflector extending from the wall of the waveguide tube, said reflector located downstream of the first probe and lying in the first longitudinal plane for reflecting said first one of said at least two orthogonally polarized signals in said first longitudinal plane back to said first probe and allowing a second one of said at least two orthogonally polarized signals in a second longitudinal plane to pass along the waveguide tube, a second probe located downstream of said reflector, extending from the wall of said waveguide tube into the interior of the waveguide tube and lying in said first longitudinal plane, a signal reflector and rotator, including a short circuit at an end of the waveguide tube, located downstream of said second probe for receiving, rotating and reflecting a second one of said at least two orthogonally polarized signals back along said waveguide tube such that the rotated and reflected signal is received by said second probe, said signal reflector and rotator comprising:

a reflector plate with a leading edge thereon to provide at least one reflecting edge portion for reflecting a first component of said second one of said at least two orthogonally polarized signals, the at least one reflecting edge portion being spaced at a desired distance from the short circuit at the end of the waveguide tube, a differential phase shifter disposed in proximity to the reflector, said differential phase shifter having a slightly asymmetrical cross section provided by an elliptical section in said waveguide tube, whereby a second component of said second one of said at least two orthogonally polarized signals is phase shifted with respect to said first component in the differential phase shift portion, then said first and second components of said second one of said at least two orthogonally polarized signals are reflected respectively from said at least one reflecting edge portion and from said short circuit before said second component is further phase shifted when traveling back through the differential phase shift portion for recombination with said first component, said first and second components having different cut off wavelengths, to provide a recombined signal for detection by said second probe.

27. A waveguide as claimed in claim 26 wherein at least one protuberance is provided on the reflector plate for suppressing any insertion loss glitches which occur within a desired frequency band.

28. A waveguide as claimed in claim 26 wherein the elliptical section further comprises a smooth transition along the waveguide tube.

29. A waveguide as claimed in claim 28 wherein the smooth transition is provided on a side of the waveguide tube parallel to the at least one reflecting edge portion.

* * * * *